US006370442B1

(12) United States Patent
Wang

(10) Patent No.: US 6,370,442 B1
(45) Date of Patent: Apr. 9, 2002

(54) AUTOMATED EMBROIDERY STITCHING

(75) Inventor: Oliver Kuan-Lan Wang, San Jose, CA (US)

(73) Assignee: Softfoundry, Inc., San Jose, CA (US)

( * ) Notice: Subject to any disclaimer, the term of this patent is extended or adjusted under 35 U.S.C. 154(b) by 0 days.

(21) Appl. No.: 09/286,109

(22) Filed: Apr. 2, 1999

Related U.S. Application Data

(60) Provisional application No. 60/081,333, filed on Apr. 10, 1998.

(51) Int. Cl.[7] ..... D05C 5/02; G06F 19/00

(52) U.S. Cl. ..... 700/138; 112/102.5; 112/475.19

(58) Field of Search ..... 700/138, 137, 700/136, 130, 131, 132; 112/102.5, 470.04, 475.19, 470.06

(56) References Cited

U.S. PATENT DOCUMENTS 3,259,089 A * 7/1966 Rockholt ..... 112/80.54
4,483,265 A 11/1984 Weidmann ..... 112/266.1
4,991,524 A 2/1991 Ozaki ..... 112/121.12
5,563,795 A * 10/1996 Futamura et al. ..... 700/138
5,839,380 A * 11/1998 Muto ..... 112/102.5
6,004,018 A * 12/1999 Kawasato et al. ..... 700/138

* cited by examiner

*Primary Examiner*—Peter Nerbun
(74) *Attorney, Agent, or Firm*—Townsend and Townsend and Crew LLP

(57) ABSTRACT

A method for embroidering includes receiving a digitized representation of an image, determining grain structures for a plurality of locations in the digitized representation, the plurality of locations including a first location and a second location, embroidering a representation of the first location using cross stitch patterns, when a grain structure for the first location indicates a bi-directional grain structure, and embroidering a representation of the first location using uni-directional stitch patterns, when the grain structure for the first location indicates a uni-directional grain structure.

41 Claims, 7 Drawing Sheets

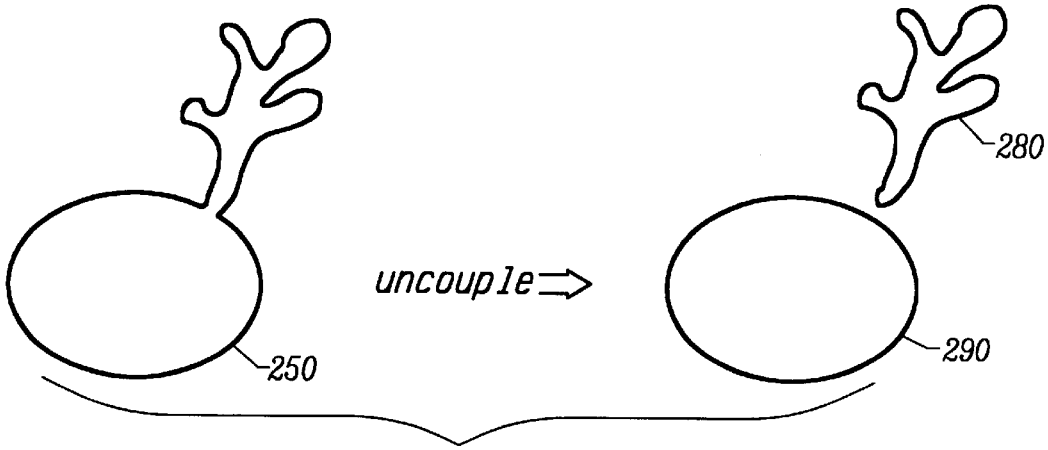
FIG. 3C
FIG. 4A
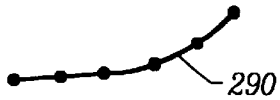
FIG. 4B
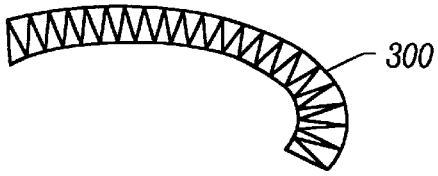
FIG. 4C
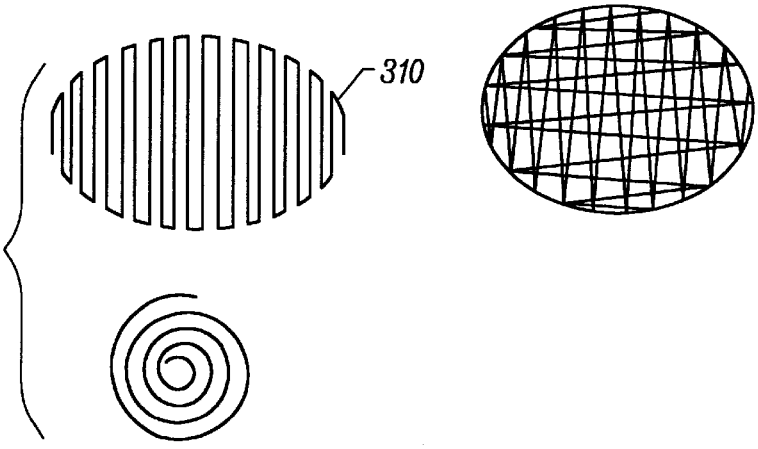

AUTOMATED EMBROIDERY STITCHING

CROSS-REFERENCES TO RELATED APPLICATIONS

This application claims priority to U.S. Ser. No. 60/081,333 filed Apr. 10, 1998, incorporated by reference herein, for all purposes.

BACKGROUND OF THE INVENTION

With the advent of computer digitizers and embroidery machines, users of embroidery machines and embroidery software have become more conscious of the need to reduce the time, labor, cost and user experience and expertise needed to convert images into embroidery stitch sequences. An embroidery machine is a device which can accept as input a series of movements and other actions (e.g., X/Y move, color change, thread trim, etc.) which correspond to a stitch sequence and sew color stitches onto fabric in an orderly fashion.

Before the use of computer software for assistance with generating stitch sequences for input to embroidery machines, a user needed to simulate the process used by hand embroiderers and sewing machine operators. In particular, the user needed visually to select various spots for receiving distinctive color and then to approximate those desired colored spots laying down series of stitch segments and sequencing the series of stitches. This process is extremely time-consuming and requires great experience.

Up to several hundred thousands of stitches or more are required to represent an image. Because of the need to use many different colored thread to cover many different areas many times, and the need to improve the embroidery machine's productivity, there is an additional requirement to organize the overall stitch sequence in an efficient way so as to minimize machine-stop events such as colored thread change and thread trim. Typically, several days of labor are required to describe manually a single, ordinary image as an adequate embroidery stitch sequence.

Since the days of purely-manual stitch sequence construction, some workers have used computer digitization software to perform a tedious step-by-step task of inputting information from an image into a computer. These techniques involve the use of digitizer tablets or computer monitor screens for detailed step-by-step digitizing tracing or selecting of distinctive borders from different areas of an image to identify the borders. Conventionally, a user must select these border edges in sequence to inform a computer that certain border curves can form a region. This process is still time consuming and inconvenient. Once regions are identified, simple computer software can be used to aid in generating certain types of stitch sequences for filling in the regions in a rudimentary manner.

Edge detecting algorithms are sometimes used to automate the process of edge identification from a computer image file. However, the edges detected by these approaches are usually broken and therefore do not form a closed region ready for stitch generation. These broken edges conventionally need to be corrected manually before individual embroidery stitches can be computed from these regions' borders and be placed within these regions following the user's instruction.

One approach to generate these embroidery stitch sequences is to divide the image into many smaller but fairly uniform colored regions if such regions can be found, and then according to the individual geometry of these regions, to pick different style of machine thread sequence to lay threads such that these regions are covered. The threads generated in each region are in a very orderly way and almost parallel to neighboring threads. There are several problems associated with this approach. One problem is that the stitches generated in this way are too orderly and lack the fine appearance from most of the images. Secondly, very few images available today can be divided into regions of similar color in an obvious way, and thirdly, even for a simple images with clear borders of uniform colored regions, it may have hundreds of smaller regions that need to be inputted into computer for stitch generation, which is very labor-intensive and time-consuming both in digitizing along the regions' borders and in selecting each of these small region's borders to form the region.

Many images (e.g., photographs) are represented by bitmaps of a vast amount of different colored pixels distributed in a very mixed and complex manner. There is no art today to automatically convert an arbitrary image bitmap into a series of embroidery stitches in an efficient manner. The only existing approach for generating embroidery stitches from this type of image is to hand-lay individual stitch threads, one by one, locally in reference to the local details of image. Since this approach needs significant experience and vast amounts of labor for each task, it is not generally practical in the machine embroidery industry. The stitches resulting from such hand-placement and hand/sequencing usually have no fixed order, appear to be very random, and frequently cross one another, to the detriment of embroidery machine efficiency and in direct contrast to the types of stitches currently capable of being generated automatically or with machine assistance.

Images exist today in the form of photos, paintings, artworks, prints, fabrics, or even computer files. The methods to convert such images to bitmap data are well-known arts. A bitmap is an N by M points of color pixel data, either residing in a computer's volatile memory (e.g., random access memory, or RAM) or nonvolatile memory (e.g., hard disk). Bitmaps on one extreme could be highly organized with a single color repeated in every pixel. Bitmaps on the other extreme could be completely random in pixel color, shade, and distribution. Thus, one can say that images as bitmaps exist in nearly infinite possibilities. The existing efforts to automate or partially automate stitch generation achieve only a limited degree of success, and for only a very limited range of image complexity/randomness.

Improved methods and systems are needed for automatic and/or machine-assisted embroidery stitch generation from an image. In particular, such improved methods and systems should reduce needed time and human labor, especially skilled labor, during the stitch-sequence generation phase. Furthermore, the stitch sequences generated from such improved methods and systems should allow for efficient stitching by embroidery machines. In addition, such improved methods and systems should be operable for a vastly greater range of image types.

SUMMARY OF THE INVENTION

An automated image processing method and system for generating a representation of an input image. One application is for reducing time and labor for constructing, e.g., computer embroidery stitches from an input image.

According to another embodiment, a method for embroidering includes receiving a digitized representation of an image, determining a plurality of regions of the image in response to the digitized representation, and determining a geometric index for each region in the plurality of regions of the image. The method also includes determining a region type associated with each regions from the plurality of regions in response to the geometric index for each region, the region types including a first region type and a second region type, embroidering representations of regions from the plurality of regions associated with the first region type; and thereafter embroidering representations of regions from the plurality of regions associated with the second region type.

According to an embodiment of the present embodiment, a method for embroidering includes receiving a digitized representation of an image, determining grain structures for a plurality of locations in the digitized representation, and the plurality of locations including a first location and a second location. The method also includes embroidering a representation of the first location using cross stitch patterns, when a grain structure for the first location indicates a bi-directional grain structure, and embroidering a representation of the first location using uni-directional stitch patterns, when the grain structure for the first location indicates a uni-directional grain structure.

According to another embodiment, an article of manufacture having embroidery sewn thereon uses one of the methods described above.

According to another embodiment, an embroidery system includes a processor, and a processor readable memory. The processor readable memory includes code that directs the processor to retrieve a digitized representation of an image, and code that directs the processor to determine a plurality of regions of the image in response to the digitized representation of the image. The memory also includes code that directs the processor to determine a geometric index for each region in the plurality of regions, code that directs the processor to determine a region type associated with each region from the plurality of regions in response to the geometric index for each region, the region types including a first region type and a second region type, code that directs the processor to direct embroidering representations of regions from the plurality of regions associated with the first region type, and code that directs the processor to direct embroidering representations of regions from the plurality of regions associated with the second region type after the representations of regions from the plurality of regions associated with the first region type.

According to another embodiment, a computer program product for a computer system including a processor comprises code configured to direct the processor to receive a digitized representation of an image, and code configured to direct the processor to determine grain structures for a plurality of locations in the digitized representation, the plurality of locations including a first location and a second location. The computer program product also includes code configured to direct the processor to direct embroidering of a representation of the first location using cross stitch patterns, when a grain structure for the first location indicates a bi-directional grain structure, and code configured to direct the processor to direct embroidering of a representation of the first location using uni-directional stitch patterns, when the grain structure for the first location indicates a unidirectional grain structure. The codes reside on a tangible media.

BRIEF DESCRIPTION OF THE DRAWINGS

In order to more fully understand the present invention, reference is made to the accompanying drawings.

FIGS. 3A–3C illustrate samples of different types of regions in coexistence.

FIGS. 4A–4C illustrate samples of different types of machined stitches.

DESCRIPTION OF THE SPECIFIC EMBODIMENTS

A specific embodiment of the present invention is directed to a method for automatic computer embroidery stitch generation from an image, for reducing the time and color required to digitize an image. For best results, input images should be clear and large with fine resolution for a meaningful representation with embroidery stitches.

Figure 1A:
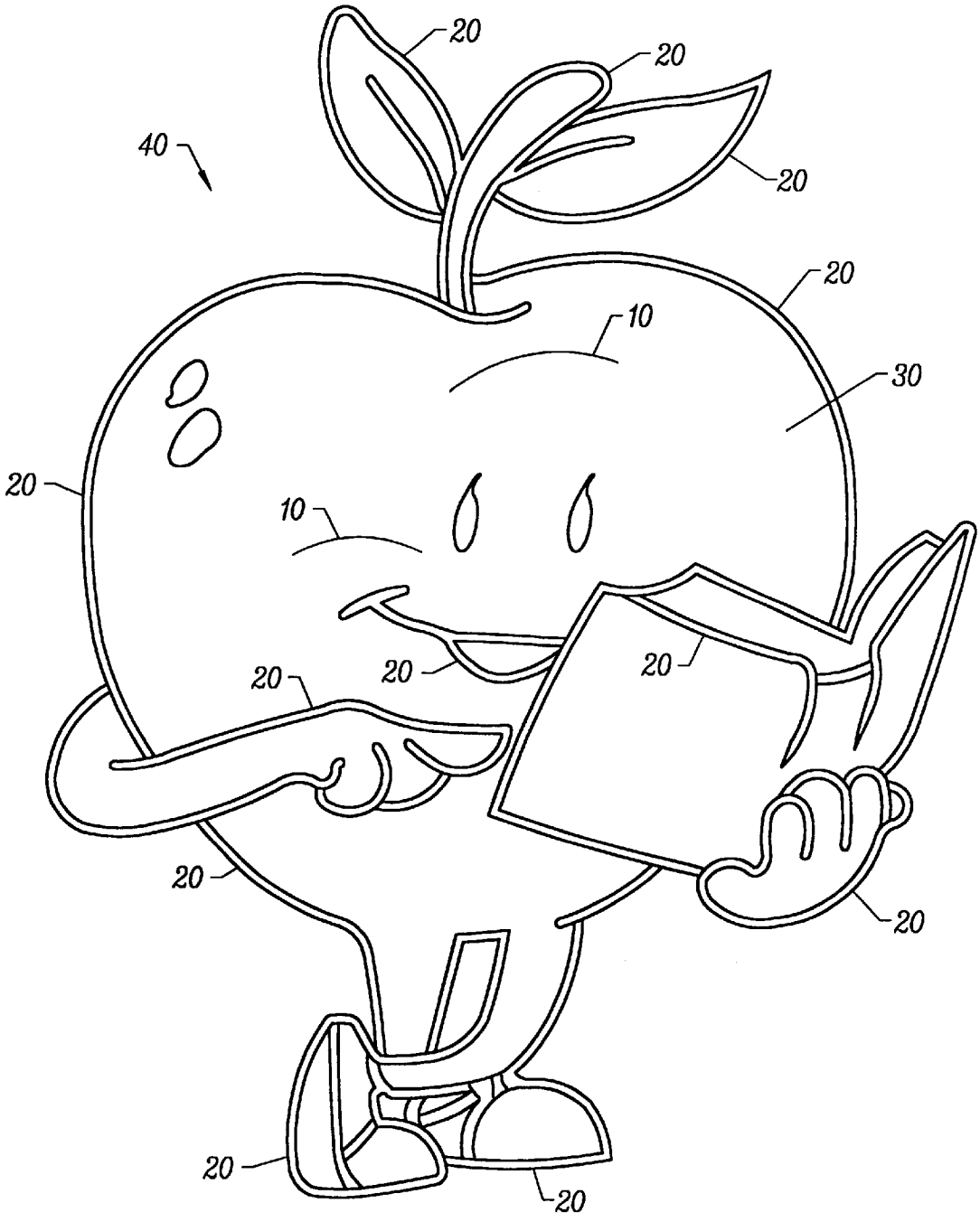
FIGS. 1A and 1B illustrate example input images.
Figure 1B:
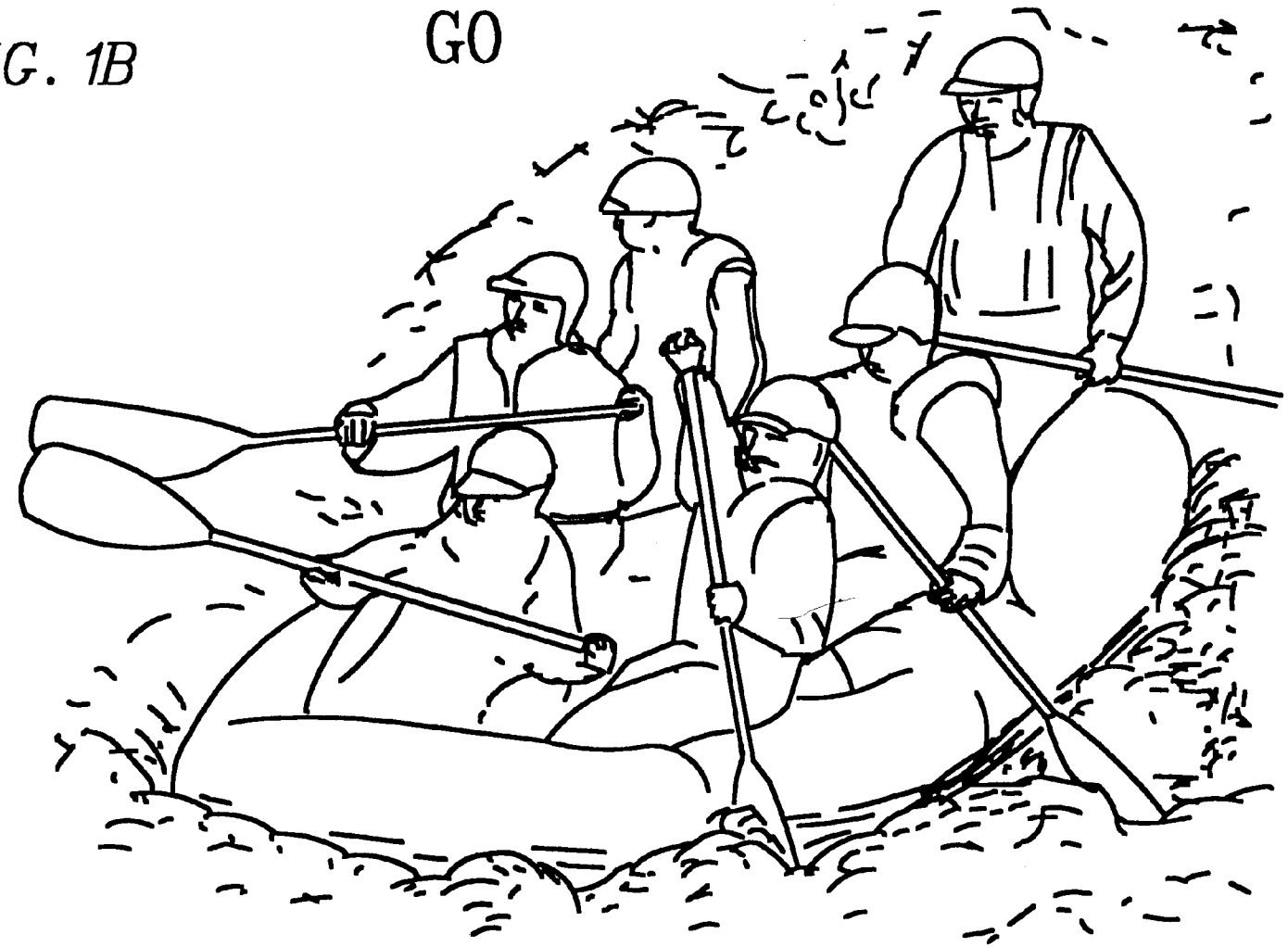

FIGS. 1A and 1B illustrate example input images. In FIG. 1A, there is shown a cartoon-like image with qualitatively different features labeled 10, 20, 30, and 40 which, as described below, variously correspond to Type 1, Type 2, and Type 3 image regions. FIG. 1B is a representation of a photograph-like image that also includes cartoon-type elements (bold text). FIG. 1B shows a scene with people in a boat, and textured water splashing all about. Any photograph that shows detailed variety in color, texture, pattern, orientation, etc, such as of a cat, may also be used as a source image.

Figure 2:
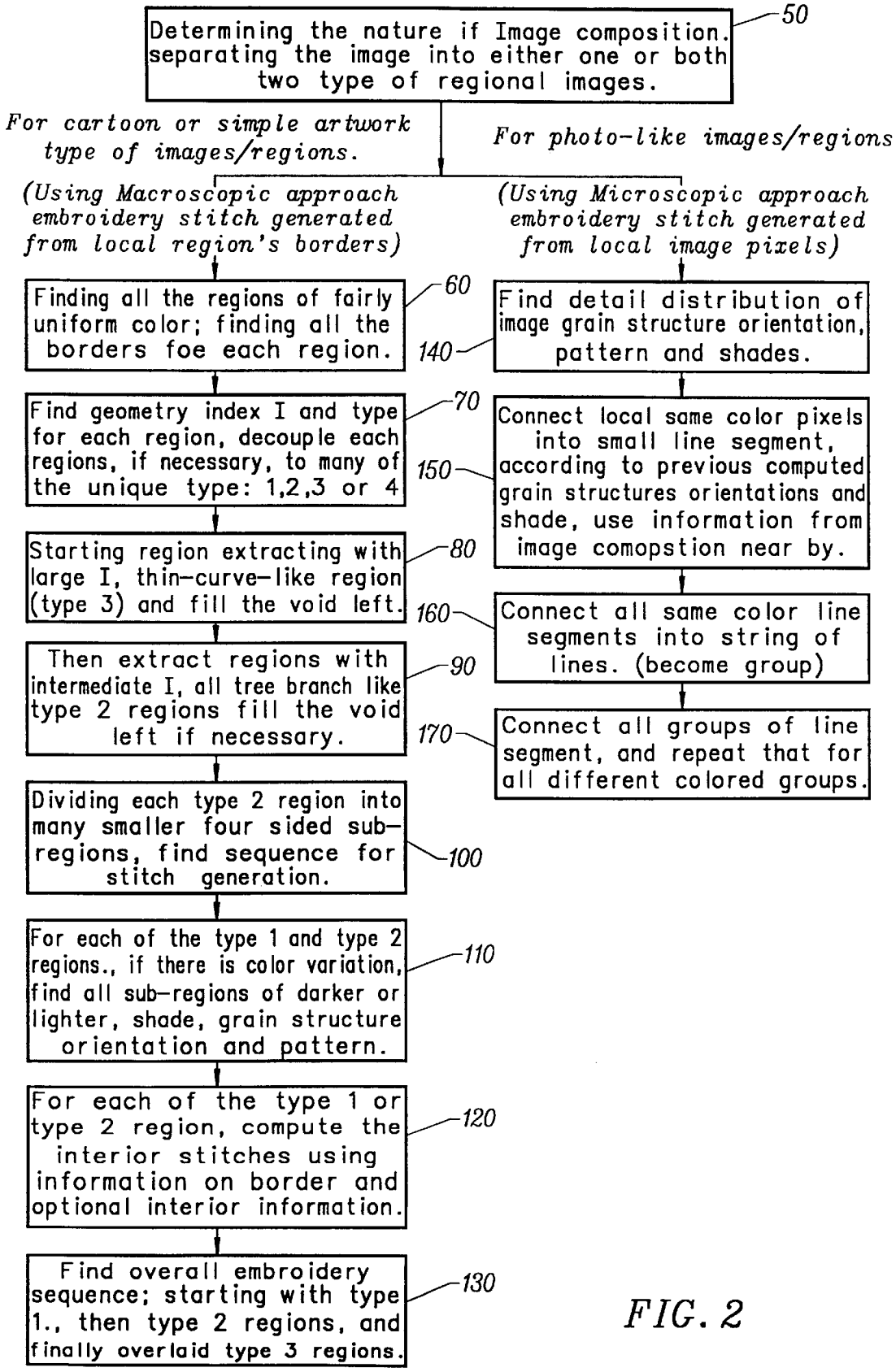
FIG. 2 is a flowchart of a method according to a specific embodiment of the present invention.

FIG. 2 is a flowchart of a method according to a specific embodiment of the present invention. FIG. 2 includes steps 50, 60, 70, 80, 90, 100, 110, 120, 130, 140, 150, 160, and 170.

Figure 3A:
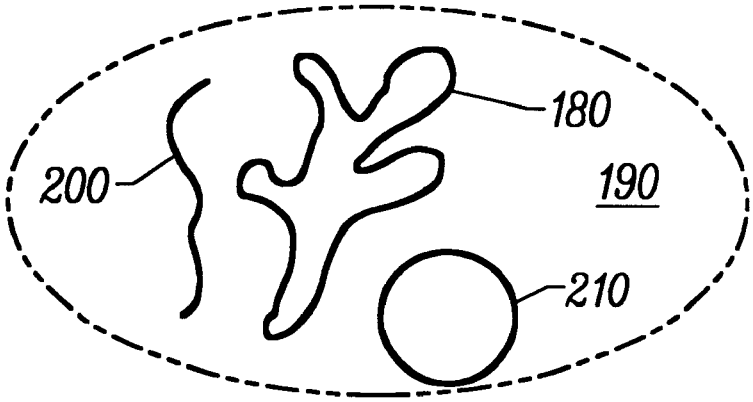
Figure 3B:
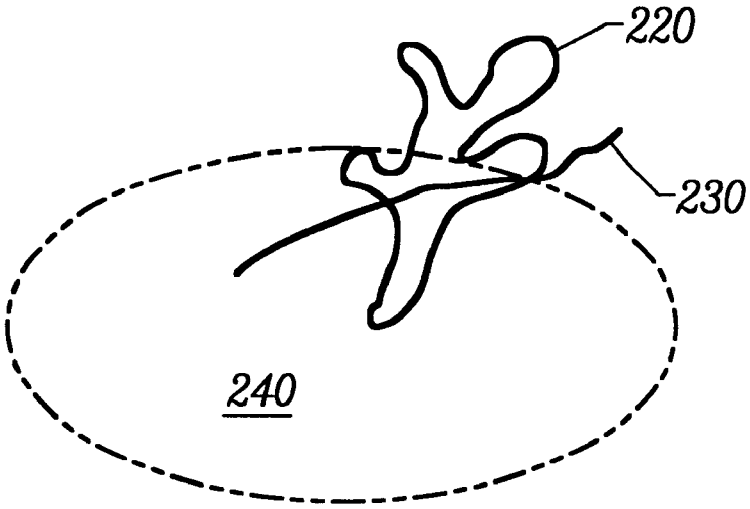

FIGS. 3A–3C illustrate samples of different types of regions in coexistence. FIG. 3A includes a Type 3 region 200, a Type 2 region 180, and a Type 1 region 210 within a Type 1 region 190. FIG. 3B includes a Type 3 region 230 over and intercepting a Type 2 region 220 and over and intercepting a Type 1 region 240. FIG. 3B also includes a Type 2 region (220) intercepting a Type 1 region (240). FIG. 3C includes a region 250 that is then uncoupled into a Type 1 region 270 and a Type 2 region 280.

FIGS. 4A–4C illustrate samples of different types of machined stitches. FIG. 4A illustrates running stitches, which are suitable for Type 3 regions. FIG. 4B illustrates zigzag stitches, which are suitable for Type 2 regions. FIG. 4C illustrates various filled stitches, which are suitable for Type 1 regions.

Figure 5:
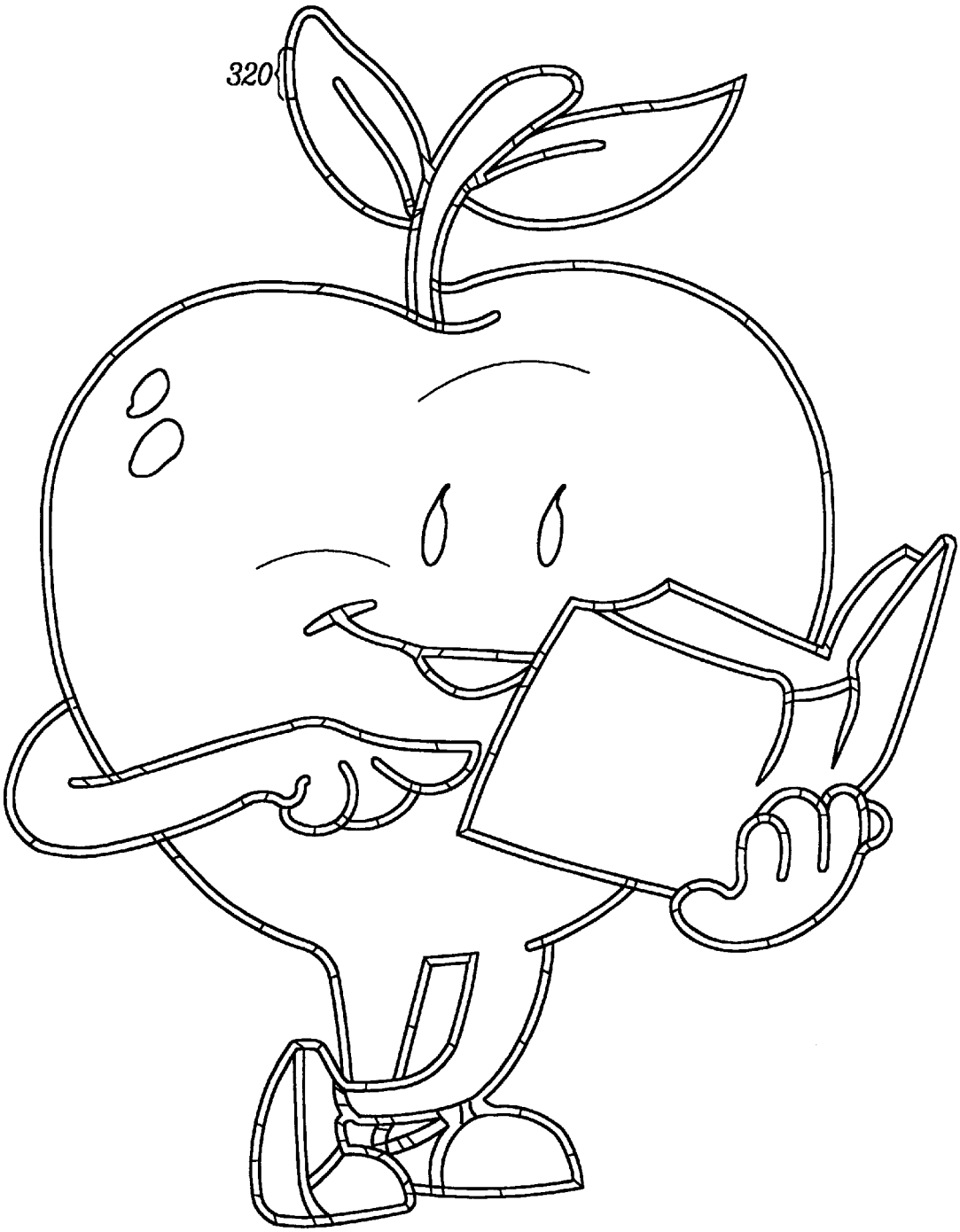
FIG. 5 illustrates an example of subdivided type 2 regions.

FIG. 5 illustrates an example of Type 2 regions which have been further subdivided into smaller regions.

THE NATURE OF AN IMAGE OR REGION

In general, an image can be as simple as a cartoon drawing (FIG. 1A) or as complicated as mixture of artwork and photos (FIG. 1B). According to the present invention, the complexity/randomness, or "nature", or "composition," of an input image or regions within the input image is automatically determined. This is shown in Step 50 of FIG. 2 for the specific embodiment.

According to the present invention, separate methods appropriate to each level of complexity/randomness are employed. In the specific embodiment of FIG. 2, two levels of complexity/randomness are handled by two branches of method steps, namely Steps 60–130 and Steps 140–170.

For determining the nature of an input image (e.g., Step 50), measurement entropy which is used in the study of deterministic chaos can be adopted. See Reference [2].

A large class of images result from photographing 3-dimensional real objects such as people, animals, plants, and scenery. These images are composed of mixtures of light signals from large numbers of randomly oriented surfaces which emit, reflect, absorb, and transparently or translucently transmit colors. In such images, the elements seem random but actually all have something in common, e.g. a same lighting source, a same nature of material in certain area(s), etc. The theory of deterministic chaos can be adopted.

The specific embodiment take as its starting point, an image to be analyzed for finding the inherent properties of different regions, in order to apply pertinent ways to generate computer stitches. In the specific embodiment, an image can be divide into chosen small regular regions for determining its properties, according to, e.g., known image processing techniques. If there is enough similarity in neighboring regions, they can be grouped into larger regions for further processing. If certain region exhibits regularity, technique revealed later in this paper can be used to extract simple images out.

Consider each smaller region. According to definition of measurement entropy for nonlinear dynamic system, the K entropy is the most important measure of chaotic system, it measures the average rate of loss of information, if K is 0, then the system is fully deterministic; if K is infinity, then the system is completely random. Otherwise, the system is deterministic chaos.

According to definition:

$$K = \lim_{\varepsilon \to 0} \lim_{t_2 \to \infty} \frac{1}{t_1 - t_2} I_\varepsilon[t_1, t_2]$$

where $$I_\varepsilon[t_1, t_2] = -\sum_{\{i\}} P(i_1, i_2, \ldots i_n) \ln P(i_1, i_2, \ldots i_n)$$

and $P(i_1, i_2, \ldots i_n)$ is when after the state space was reconstructed into n dimensional space with unit length of $\epsilon$, and when time between $t_1$ to $t_2$ was divided into n intervals, the joint probability of its state falling into these grids.

For image processing, the data can be viewed as the information from a dynamic system in different stages. Following Reference [3]. Approximate entropy is an efficient way to compute for measurement entropy.

Typically, the data making up a time series $\{x(t_i)\}$, i=1, . . . , N, are of lower dimension than the actual dynamics.

After the state space reconstruction using the delay vector of embedding dimension M, the series of M dimension vectors are:

$$X(1), X(2), \ldots X(N-(M-1)L)$$

where $$X(i)=x(i), x(i+L), \ldots x(i+(M-1)L);\ i=1,2, \ldots, N-(M-1)L$$

define as delay vector.

N is the total sampling point count and L is the sampling interval count.

Define the distance between vector X(i) and X(j) as:

$$d[X(i),X(j)]=\max(|x(i+(k-1)L)-x(j+(k-1)L)|);\ k=1,2, \ldots M$$

Define:

$$C_i^M(r) = \frac{1}{N-M+1} \times (\text{the total numbers count of } J\text{'s for varying } J, \text{ under the condition of } d[X(i), X(j)] \le r)$$

and:

$$\Phi^M(r) = \frac{1}{N-M+1} \sum_{i=1}^{N-M+1} \ln C_i^M(r)$$

Approximate entropy ApEn(M, r, N) can be defined as $$\mathrm{ApEn}(M, r, N) = \Phi^M(r) - \Phi^{M+1}(r)$$

Values of M, r, N and L can be chosen to adjust the sensitivity for detecting different image natures, where M=2, r=0 to 15, N=500 to 1000, L=1, can yield satisfactory results for common image types. In other embodiments of the invention, other ways to approximate entropy may be used.

The above expression is used to evaluate the local nature of images ranging from the simple cartoon artwork to complicated photos. For example, values of the expression may be compared with predetermined threshold value(s), and values to one side of a threshold would indicate one nature and values to the other side would indicate another nature. Once the nature of image is identified for many sub-areas of the image (Step 50 of FIG. 2), methods from the specific embodiment of the present invention, e.g., macroscopic stitch generation or microscopic stitch generation, can be applied to designated area of image for automatic stitch generation.

MACROSCOPIC STITCH GENERATION

In Step 60, the cartoon-like or simple artwork type of image is partitioned into regions of fairly uniform color, and a border is determined for each region.

For cartoon-like or simple artwork type of image, well-known techniques such as the quantification of each image pixel based on RGB or UVW space is used to assign a quantified number to each pixel. Examples of such well-known image processing technique is discussed in Reference [1]. The result of such calculation assigns a quantified number to each pixel. Scanned samples of already embroidered work can be processed by this same method.

For every pixel in the image, compare the quantified number with that of all adjacent pixels. If the difference of this number is small enough, based, e.g. on comparison with a predetermined threshold, one can say that their color are similar and can be merged into a same region. This process is repeated until all the pixels are used and all the regions are formed. It is relatively easy to find all the pixels on the border of each region and therefore each region has pixels on the border and pixels not on border.

In Step 70, a metric (or multiple metrics, in other embodiments) is computed for each region that is indicative of its geometric quality. From this metric, the each region can be classified according to a geometry classification system. In the specific embodiment, the metric measures the "thinness" of a region's shape.

One can perform the pixel count $P_B$ for border pixels and the pixel count $P_A$ interior area pixel including border pixel for each region. A geometry index I can be formally defined as, e.g., $$\frac{P_B^2}{P_A}$$

This is a preferred formulation of the geometry index I. The higher the index, the more "thin" is the region, and the lower the index, the more "thick," or "full," is the region. Other metrics for geometry indices may be used to determine "thinness." For example, any expression that tends to get larger (or smaller) as $P_B$ exceeds $P_A$ would have some utility. For example:

$$\frac{P_B}{P_A}$$

The macroscopic approach of the specific embodiment takes each region's geometry index I as its starting point. From these indices I, the regions are classified into some number of geometry types, e.g., by comparison with threshold values, along with other considerations. The threshold may be predetermined by testing the specific system in question with a variety of input and finding the values that give good performance.

With illustrative reference to FIG. 1A:

1. Regions labeled 10 (type 3) are thin curve-like region with very high index I value;
2. Regions labeled 20 (type 2) are thicker in local width compared with region type 3, therefore moderately high index I value; and Regions labeled 30 (type 1) are relatively large area and with similar dimension when measured on two perpendicular axes, the value of index I is small; and
3. A region labeled 40 (type 4) has pixels on the exterior edge of the image and upon further analysis may be recognized as background region.

FIG. 1A is an example of just one simple image for embodying the present invention. It will be readily apparent to one of ordinary skill in the art that a vast number of images are suitable for use in conjunction with the present invention. More specifically as non-exhaustively illustrated in FIG. 3, the first 3 types of regions can be nested or intersected or separated with each other in many ways and in lots of images; any combination of two types of regions mentioned previously are also considered suitable for the present invention. For ease of future of operation, some region can be split into 2 or more different Type 2 or Type 1 regions, judging by the geometry difference in different portions of this region. If all region's colors add up to exceed allowable colors from the designated embroidery machines, similar colored regions can be forced to have a same color, to thereby reduce the overall number of colors used.

In the specific embodiment, if local coexistence of Type 3 of area (thin curve-like) with Type 1 or Type 2 of areas, Type 3 area is always embroidered last and overlaid on previously embroidered Type 1 or Type 2 areas.

In Step 80 of the specific embodiment of present invention, all Type 3 regions are extracted first and are fitted with spline curves. In later steps of stitch generation, these curves will be organized and embroidered last such that they can be overlaid on previously embroidered Type 1 and/or Type 2 areas. A representation of actual embroidery stitch for Type 3 areas is called running stitches is shown as 290 in FIG. 4A. The pixels belonging to extracted Type 3 area, i.e., the void can be changed to the color number of adjacent region's pixels, be ready for next round of operation.

In the specific embodiment, slight color variations are allowed within Type 1 and/or Type 2 regions. The techniques to be cited later in this paper can be used to obtain detailed image grain structures and orientations shading distribution directly from the original input image, which has not been quantized into regions each of uniform color. This image nature information is then saved and later is used for stitch generation within these areas. This is a powerful feature which greatly adds to the quality of the output embroidery for many types of input images.

In Step 90, once all the Type 3 regions were identified and extracted, the next step in the specific embodiment is to operate on Type 2. Many pairs of spline curves are derived and fitted across all local width (FIG. 5), each Type 2 region is divided into many 4 sided sub-regions 320. Once these 4 sided sub-regions are adjusted along the border to reasonable geometry, zigzag or satin stitches (FIG. 4B) 300 are generated for each sub-region, and hence for the whole Type 2 region, according to known methods in the art.

In the specific embodiment of this invention, the following criteria can be used to evaluate a Type 2 region:

1. The area of this region is relatively small.
2. The geometry index I is relatively large.
3. The region is completely fit into other region.
4. The region is in between two or more regions of the same color.

If the subjected Type 2 region satisfies most of these criteria, this region can be set as an option to be extracted out and later be overlaid as stitches on top of stitches previously embroidered from other regions. In that case, the pixels which used to be in this Type 2 region (i.e., the void) can be changed to the color of adjacent regions. Thus, there is a step of determining whether the Type 2 region should be overlaid on top of other stitches.

In the case of a Type 2 region is in between the border of 2 or more Type 1 regions of same color, if this Type 2 region is extracted out for generating overlaid stitches, the present invention takes these bordering Type 1 regions and group them into one Type 1 region.

In the next Steps 110 and 120 embroidery stitches within each of the Type 1 regions (FIG. 4C) 310 are computed. With or without the use of previously computed image composition ("image nature") information, Type 1 region may have one or more Type 2 regions embedded within.

In Step 130, the specific embodiment provides a means to find the image information composition and be used as a reference for generating embroidery stitches directory from the border of this region.

The specific embodiment of this invention can find its application in automatic stitch generation from a scanned sample of actual embroidery work. The local image grain directions described later, in conjunctions with the finding of regions and borders can be adopted.

As to the region of Type 4 (background region) 40, it is usually optionally omitted and need not be of concerned. If there is a need to also generate stitches for any or all of this type of region, the method used is identical to those described previously for Type 1 or Type 2 regions.

MICROSCOPIC STITCH GENERATION

As stated previously, a large fraction of the images in the form of computer bitmaps are taken from photos of complicated 3-D objects. Using the method described previously, bitmaps can be found as deterministic chaos, in this case, both the pixels distribution and edge extraction are very fragmentary and it is very difficult to use it to generate embroidery stitches. Even if some of the images can be approximated by identifying regions for stitch generation by the method stated previously, the resulting stitches could appear too orderly and plain.

The specific embodiment of present invention use a method to link local adjacent pixels for forming the embroidery stitches directly, without the need to find borders of region containing these local pixels. Using a high resolution computer monitor as an example, each pixel is about 0.25 mm, comparable to embroidery thread width, between 4 and 20 pixels could be linked to a line segment, which is comparable to the machine embroidery stitch length, commonly between 1 mm to 5 mm. Thus the automatic steps needed are to find the distribution, stitch length and sequence for all different colored stitch segments. This is a difficult problem and has likely not been previously unexplored.

Image Grain Structure Determination

In Step 140, the image grain structure is determined.

Applying the well-known technique of two-dimensional DFT, Reference [1], A 2-dimensional discrete Fourier transform (DFT) of a sampled 2-D signal h $(k_1,k_2)$ is given by $$H(n_1, n_2) = \sum_{k_1=0}^{N-1} \sum_{k_2=0}^{N-1} h(k_1, k_2) e^{-j2\pi/N*(n_1k_1+n_2k_2)} = DFT\{h(k_1, k_2)\}$$

where $n_1 = 0, 1, 2, \cdots, N-1$ and $n_2 = 0, 1, 2, \cdots, N-1$

In discretized form, $k_1,k_2$ is the location number of local pixels; in continuous form, using u, υ instead of $n_1$, $n_2$, define a power H(u, υ) as:

$$T(u, \upsilon)=\log_{10}(1+|H(u, \upsilon)|)$$

for slowing down the decreasing of spectra in increasing frequencies.

Repeatedly apply DFT to predetermined locations of images over its adjacent region, T(u, υ) values are now computed for each predetermined location point within this image.

Transform T(u, υ) into the polar coordinates of (r, ϕ)

Define $$T(r) = \sum_{i=1}^{n} T(r, \phi_i)$$

where $$\phi_{i+1}+\phi_i=\pi/n \text{ and } r=r_1,r_2, \ldots r_n$$

means, for each r value, one can find H value around the circular path of fixed r.

Similarly, define $$T(\phi) = \sum_{i=1}^{n} T(r_i, \phi)$$

where $$r_{i+1}-r_i={}^{W}/_{2n} \text{ and } \phi=\phi_1,\phi_2, \ldots \phi_n$$

means, for each ϕ value, one can find H value along the r direction.

One can now investigate the curve of T(ϕ) VS. ϕ and find number of wave peak, denote it as N. Following result can be recorded:

a. if N is equal to 1 or 2, then it is clear that there is Uni. Or bi-directional grain structure around this point. In this case, the grain directions can be easily determined;
b. if T(r) is constant, then it indicates that there is no directional grain existing at this point;
c. if T(r) fluctuates, it indicates that images near this point are very fragmentary and spotty; and
d. finally, if N is changing rapidly from point to point in a small region of image, it indicates that there is a pattern in this region and one can repeatedly use the same technique of DFT over a refined grid to find detail of this pattern.

The specific embodiment of present invention utilizes previous findings as in a, b, c and d, for reference to derive the pixel linking and line forming process in the following manners.

Case a: local pixels are linked parallel to the local grain direction found previously and it also means that parallel stitches are created for Uni.-directional grain and cross stitches are generated for bi-directional grain.

Case b: local pixels are linked parallel to a fixed given direction. The result could either be one direction stitches or bi-directional stitches.

Case c: local least square method are adopted, for pixels distributed in local (x, y) random stitches could be found.

Case d: pixels will be linked to closely follow the details of patterns.

Each line segment can be made short (using fewer pixel) or long (using more pixels) according to the local color intensity of these pixels. Thus, shorter stitches have more dense stitching needle points can contribute to darker shade and, longer stitches have fewer needle points can contribute to lighter shade.

In the specific embodiment of this invention, a large number of individual same colored short line segments in the same area can be connected together by tie-in pairs of most closely situated end points from each line segment 150. Many of the as-tied end points can be merged into one point if the distance between them is too small. This line linking process is continued until the current end point can not find a nearest end point with acceptable distance. This process can temporally be hold and the already connected line segments can form a group 160. The process is continued until all the line segments are used in forming many groups.

One note worth taken is that the starting and end point of any group of lines can be switched or made to coincide as one point (in this case, one extra underlay line of stitch is generated under this group of lines. ) This property of changeable starting and ending point in a group of lines is very important as it provides more flexible ways to connect group of lines. Interactive test could be used to find the right sequence of connecting all various group of lines from different color, such that the occurrence of long exposed connecting line between groups are minimized 170.

The embroidery field can sometimes still be considered as an art and without any fixed and unique way for stitch preparation. The system and method described herein can process a large class of input images. For certain images, a better final result can be achieved after making slight modification to either the stitch sequence generated by the specific embodiment or to the image itself (for reprocessing by the present invention).

The invention has now been explained with reference to specific embodiments. The present invention relates to methods and systems for deriving information from images and generating command sequences from such information for creating stylized renditions of those images. A particular application is to machine embroidery wherein the present invention generates embroidery stitch sequences and optionally operates an embroidery machine using the generated stitch sequences as an input.

Other embodiments will be apparent to those of ordinary skill in the art in view of the foregoing description. For example, the "stitch sequences" could also correspond to a generic line-art representation of images, which have aesthetic appeal even when printed on other media or when displayed on a computer display.

Figure 6:
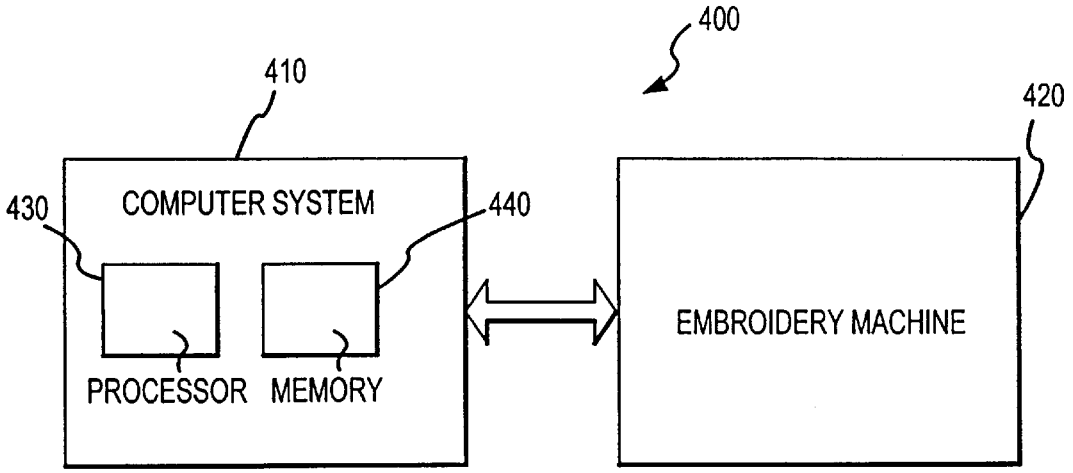
FIG. 6 illustrates a system block diagram according to one embodiment of the present invention.

FIG. 6 illustrates a system block diagram according to one embodiment of the present invention. The embroidery system 400 includes a computer system 410 coupled to an embroidery machine 420. Computer system 410 typically includes a processor 430 coupled to a memory 440. Processor 430 may be embodied as a microprocessor from Intel, AMD, Motorola, and the like. Memory 440 may include random access memory (RAM), a hard disk drive, removable storage devices, and the like.

It is envisioned herein that the present invention will find its implementation in a software program on a computer-readable storage medium (memory 440) within a computer system, wherein the computer system 410 may be coupled to send its output to an embroidery machine 420 and which computer system 410 may form a part of an automated embroidery system 400. Such an embodiment is therefore to be considered within the scope of the present invention. Other embodiments are described in the attached appendices.

The scope of the invention is therefore indicated by the appended claims rather than the foregoing description and all changes that come within the meaning and range of equivalents thereof are intended to be considered as being embraced within their scope. It will be appreciated by those skilled in this particular art that the present invention can be embodied in other specific forms without departing from the spirit or essential characteristics thereof.

What is claimed is:

1. A method for embroidering comprises:

receiving a digitized representation of an image;

performing a spectral analysis on the image to determine grain structures for a plurality of locations in the digitized representation, the plurality of locations including a first location and a second location;

embroidering a representation of the first location using bi-directional stitch patterns, when a grain structure for the first location indicates a bi-directional grain structure; and embroidering a representation of the first location using uni-directional stitch patterns, when the grain structure for the first location indicates a uni-directional grain structure.

2. The method of claim 1 further comprising:

embroidering a representation of the first location using pre-determined fill patterns, when the grain structure for the first location indicates a reduced directional grain structure.

3. The method of claim 1 wherein embroidering the representation of the first location using unidirectional stitch patterns, comprises:

determining a stitch length for the representation of the first location, in response to a color intensity at the first location; and embroidering the representation of the first location using stitches having the stitch length.

4. The method of claim 1 further comprising:

embroidering a representation of the second location using uni-directional stitch patterns, a direction for the unidirectional stitch patterns associated with the first location different from a direction for the uni-directional stitch patterns associated with the second location.

5. The method of claim 1 wherein the image is a photograph.

6. The method of claim 1 wherein performing a spectral analysis on the image to determine grain structures for a plurality of locations in the digitized representation comprises using a discrete Fourier transform.

7. A method for embroidering comprises:

receiving a digitized representation of an image;

determining a plurality of regions of the image in response to the digitized representation;

determining a geometric index comprising a relative thickness indicator for each region in the plurality of regions of the image;

determining a region type associated with each region from the plurality of regions in response to the geometric index for each region, the region types including a first region type and a second region type;

embroidering representations of regions from the plurality of regions associated with the first region type; and thereafter embroidering representations of regions from the plurality of regions associated with the second region type.

8. The method of claim 7 wherein determining region types associated with regions from the plurality of regions includes determining a region associated with a first region type;

the method further comprising:

segmenting the region associated with the first region type into a first region associated with the first region type and a second region associated with the second region type.

9. The method of claim 7 wherein determining the region type associated with each regions from the plurality of regions is in response to the relative thickness indicator of each regions in the plurality of regions.

10. The method of claim 7 wherein the representations of regions from the plurality of regions associated with the second region type are overlaid over representations of regions from the plurality of regions associated with the first region type.

11. The method of claim 7 wherein embroidering representations of regions from the plurality of regions associated with the first region type comprises:

determining a grain structure for a location in a region associated with the first region type;

embroidering a representation of the location of the region using uni-directional stitch patterns, when the grain structure for the location indicates a uni-directional grain structure.

12. The method of claim 11 wherein embroidering the representation of the location using uni-directional stitch patterns, comprises:

determining a stitch length for the representation of the first location, in response to a color intensity at the first location; and embroidering the representation of the first location using stitches having the stitch length.

13. A computer program product for a computer system including a processor comprises:

code configured to direct the processor to receive a digitized representation of an image;

code configured to direct the processor to perform a spectral analysis on the image to determine grain structures for a plurality of locations in the digitized representation, the plurality of locations including a first location and a second location;

code configured to direct the processor to direct embroidering of a representation of the first location using bi-directional stitch patterns, when a grain structure for the first location indicates a bi-directional grain structure; and code configured to direct the processor to direct embroidering of a representation of the first location using uni-directional stitch patterns, when the grain structure for the first location indicates a uni-directional grain structure;

wherein the codes reside on a tangible media.

14. The computer program product of claim 13 further comprising:

code configured to direct the processor to direct embroidering of a representation of the first location using pre-determined fill patterns, when the grain structure for the first location indicates a reduced directional grain structure.

15. The computer program product of claim 13 wherein the code configured to direct the processor to direct embroidering of the representation of the first location using unidirectional stitch patterns, comprises:

code configured to direct the processor to determine a stitch length for the representation of the first location, in response to a color intensity at the first location; and code configured to direct the processor to direct embroidering of the representation of the first location using stitches having the stitch length.

16. The computer program product of claim 13 further comprising:

code configured to direct the processor to direct embroidering of a representation of the second location using uni-directional stitch patterns, a direction for the uni-directional stitch patterns associated with the first location different from a direction for the uni-directional stitch patterns associated with the second location.

17. The computer program product of claim 13 wherein the image is a photograph.

18. The computer program product of claim 13 wherein code configured to direct the processor to perform a spectral analysis on the image to determine grain structures for a plurality of locations in the digitized representation comprises code configured to direct the processor to execute a discrete Fourier transform.

19. An embroidery system including:

a processor; and a processor readable memory comprising:

code that directs the processor to retrieve a digitized representation of an image;

code that directs the processor to determine a plurality of regions of the image in response to the digitized representation of the image;

code that directs the processor to determine a geometric index comprising a relative thickness indicator for each region in the plurality of regions;

code that directs the processor to determine a region type associated with each region from the plurality of regions in response to the geometric index for each region, the region types including a first region type and a second region type;

code that directs the processor to direct embroidering representations of regions from the plurality of regions associated with the first region type; and code that directs the processor to direct embroidering representations of regions from the plurality of regions associated with the second region type after the representations of regions from the plurality of regions associated with the first region type.

20. The embroidery system of claim 19 wherein the code that directs the processor to determine region types associated with regions from the plurality of regions includes code that directs the processor to determine a region associated with a first region type;

the processor readable memory further comprising:

code that directs the processor to segment the region associated with the first region type into a first region associated with the first region type and a second on associated with the second region type.

21. The embroidery system of claim 19 wherein the code that directs the processor to determine a region type associated with each region from the plurality of regions is in response to the relative thickness index of each regions from the plurality of regions.

22. The embroidery system of claim 19 wherein the representations of regions from the plurality of regions associated with the second region type are overlaid over representations of regions from the plurality of regions associated with the first region type.

23. The embroidery system of claim 19 wherein the code that directs the processor to direct embroidering of representations of regions from the plurality of regions associated with the first region type comprises:

code that directs the processor to determine a grain structure for a location in a region associated with the first region type; and code that directs the processor to direct embroidering of a representation of the location of the region using uni-directional stitch patterns, when the grain structure for the location indicates a uni-directional grain structure.

24. The embroidery system of claim 23 wherein the code that directs the processor to direct embroidering of the representation of the location using uni-directional stitch patterns, comprises:

code that directs the processor to determine a stitch length for the representation of the first location, in response to a color intensity at the first location; and code that directs the processor to direct embroidering of the representation of the first location using stitches having the stitch length.

25. The method of claim 1 further comprising determining a set of locations from the plurality of locations in the digitized representation having a grain structure similar to the grain structure for the first location;

wherein embroidering the representation of the first location using uni-directional stitch patterns comprises embroidering the representation of the first location and a representation of the set of locations using the uni-directional stitch patterns.

26. The method of claim 25 wherein the first location and the set of locations form a region having a perimeter; and wherein the perimeter of the region is not computed.

27. The method of claim 7 wherein determining the plurality of regions on the image is in response to color of pixels in the digitized representation.

28. The method of claim 7 wherein determining the geometric index comprises:

finding borders of a region in the plurality of regions;

splitting the region into a plurality of sub-regions;

determining a geometric index comprising a relative thickness indicator for each sub-region in the plurality of sub-regions.

29. The method of claim 28 further comprising determining a region type associated with each sub-region in response to the geometric index for each sub-region, the region types including the first region type and the second region type;

wherein embroidering representations of regions from the plurality of regions associated with the first region type comprises embroidering representations of sub-regions from the region associated with the first region type; and wherein embroidering representations of regions from the plurality of regions associated with the second region type comprises embroidering representations of sub-regions from the region associated with the second region type.

30. The method of claim 7 further comprising:

determining a first region from the plurality of regions, the first region associated with the second region type;

determining a second region and a third region from the plurality of regions, the second region and third region associated with the first region type, the second region and the third region separated by at least a portion of the first region; and merging the portion of the first region, the second region, and the third region into a fourth region, the fourth region associated with the first region type;

wherein embroidering representations of regions from the plurality of regions associated with the first region type comprises embroidering the fourth region; and wherein embroidering representations of regions from the plurality of regions associated with the second region type comprises embroidering the portion of the first region over a portion of the fourth region.

31. The method of claim 30 wherein embroidering representations of regions from the plurality of regions associated with the second region type comprises embroidering the representations with stitches selected from the group: running stitches, zig-zag stitches.

32. The computer program product of claim 13 further comprising:

code that directs the processor to determines a set of locations from the plurality of locations in the digitized representation having a grain structure similar to the grain structure for the first location;

wherein code that directs the processor to direct embroidering of the representation of the first location using uni-directional stitch patterns comprises code that directs the processor to direct embroidering of the representation of the first location and a representation of the set of locations using the uni-directional stitch patterns.

33. The computer program product of claim 32 wherein the first location and the set of locations form a region having a border; and wherein the perimeter of the border is not pre-computed.

34. The embroidery system of claim 19 wherein the code that directs the processor to determine the plurality of regions on the image in response to the digitized representation of the image comprises code that directs the processor to determine the plurality of regions on the image is in response to color of pixels in the digitized representation.

35. The embroidery system of claim 19 wherein code that directs the processor to determine the geometric index comprises:

code that directs the processor to determine borders of a region in the plurality of regions;

code that directs the processor to sub-divide the region into a plurality of sub-regions;

code that directs the processor to determine a geometric index comprising a relative thickness indicator for each sub-region in the plurality of sub-regions.

36. The embroidery system of claim 35 wherein the processor readable memory further comprises:

code that directs the processor to determine a region type associated with each sub-region in response to the geometric index for each sub-region, the region types including at least the first region type and the second region type;

wherein code that directs the processor to direct embroidering representations of regions from the plurality of regions associated with the first region type comprises code that directs the processor to direct embroidering representations of sub-regions from the region associated with the first region type; and wherein code that directs the processor to direct embroidering representations of regions from the plurality of regions associated with the second region type comprises code that directs the processor to direct embroidering representations of sub-regions from the region associated with the second region type after the representations of sub-regions from the region associated with the first region type.

37. The embroidery system of claim 19 wherein the processor readable memory further comprises:

code that directs the processor to determine a first region from the plurality of regions, the first region associated with the second region type;

code that directs the processor to determine a second region and a third region from the plurality of regions, the second region and third region associated with the first region type, the second region and the third region separated by at least a portion of the first region; and code that directs the processor to merge the portion of the first region, the second region, and the third region into a fourth region, the fourth region associated with the first region type;

wherein code that directs the processor to direct embroidering representations of regions from the plurality of regions associated with the first region type comprises code that directs the processor to direct embroidering the fourth region; and wherein code that directs the processor to direct embroidering representations of regions from the plurality of regions associated with the second region type comprises code that directs the processor to direct embroidering the portion of the first region over a portion of the fourth region.

38. The embroidery system of claim 37 wherein the second region type comprises regions having a relative thickness indicator thinner than regions associated with the first region type.

39. The embroidery system of claim 37 wherein regions from the plurality of regions associated with the first region type are represented with stitches selected from the class: zig-zag stitches, filled stitches.

40. The method of claim 3 wherein the digitized representation of an image comprises pixels and;

wherein determining a stitch length for the representation of the first location comprises connecting pixels from the digitized representation along a local direction.

41. The computer program product of claim 15 wherein the digitized representation of an image comprises pixels and;

wherein the code that directs the processor to determine a stitch length for the representation of the first location comprises code that directs the processor to connect pixels from the digitized representation along a local direction.

* * * * *